US009402487B2

(12) United States Patent
Jensen

(10) Patent No.: US 9,402,487 B2
(45) Date of Patent: Aug. 2, 2016

(54) HANGING DEVICE FOR BELTS

(71) Applicant: ZJH Holdings, LLC, Provo, UT (US)

(72) Inventor: Jeffrey Jensen, Springville, UT (US)

(73) Assignee: ZJH Holdings, LLC, Provo, UT (US)

( * ) Notice: Subject to any disclaimer, the term of this patent is extended or adjusted under 35 U.S.C. 154(b) by 0 days.

(21) Appl. No.: 14/046,810

(22) Filed: Oct. 4, 2013

(65) Prior Publication Data

US 2014/0097213 A1 Apr. 10, 2014

Related U.S. Application Data

(60) Provisional application No. 61/710,360, filed on Oct. 5, 2012.

(51) Int. Cl.

| | |
|---|---|
| ***A41D 27/22*** | (2006.01) |
| ***A47F 7/19*** | (2006.01) |
| ***A47F 5/00*** | (2006.01) |
| ***A47G 25/74*** | (2006.01) |

(52) U.S. Cl.

CPC ..... *A47F 7/19* (2013.01); *A47F 5/0006* (2013.01); *A47G 25/743* (2013.01)

(58) Field of Classification Search

CPC ..... A47G 25/36; A47G 25/74; A47G 25/743; A47G 25/746

USPC ..... 223/85, 87, 88, DIG. 1; 211/85.2

See application file for complete search history.

(56) References Cited

U.S. PATENT DOCUMENTS

| | | | | | |
|---|---|---|---|---|---|
| 1,420,604 | A | | 6/1922 | Allen | |
| 1,619,742 | A | * | 3/1927 | Mayhew | 223/87 |
| 2,349,200 | A | * | 5/1944 | Ringler | 223/87 |
| 2,492,226 | A | * | 12/1949 | Kohl et al. | 211/85.3 |
| 2,634,476 | A | | 4/1954 | Mishkin et al. | |
| 2,889,934 | A | * | 6/1959 | Vidach | 223/85 |
| 2,988,228 | A | * | 6/1961 | Marchetti | 211/85.3 |
| 3,001,675 | A | * | 9/1961 | Aynes et al. | 223/88 |
| 3,112,496 | A | | 12/1963 | Dritz | |
| 3,945,500 | A | * | 3/1976 | Meckstroth | 211/113 |
| 4,170,808 | A | | 10/1979 | Knowles | |
| 4,179,755 | A | | 12/1979 | Clark | |
| 4,453,655 | A | * | 6/1984 | Smilow et al. | 223/87 |
| 4,930,692 | A | * | 6/1990 | Smilow et al. | 223/85 |
| D321,795 | S | * | 11/1991 | Winston | D6/328 |
| 5,572,747 | A | * | 11/1996 | Cheng | 2/322 |
| 5,799,843 | A | * | 9/1998 | Hsu | 223/85 |

(Continued)

FOREIGN PATENT DOCUMENTS

| | | | | |
|---|---|---|---|---|
| FR | 2714103 A1 | * | 6/1995 | E05B 69/02 |
| JP | 2010178836 A | * | 8/2010 | A47G 29/00 |

OTHER PUBLICATIONS www.ansonbelt.com. Anson Belt & Buckle: The Tech. Published circa May 2012.

(Continued)

*Primary Examiner* — Nathan Durham

(74) *Attorney, Agent, or Firm* — Snow Christensen & Martineau; Randall B. Bateman; Tenley H. Schofield

(57) ABSTRACT

A hanging mechanism includes a portion which is insertable into a belt buckle of a belt to engage a ratchet mechanism associated with the belt buckle. The hanging mechanism is used to suspend the belt for display purposes or for storage in a closet, etc.

24 Claims, 9 Drawing Sheets

(56) References Cited

U.S. PATENT DOCUMENTS

| | | | | |
|---|---|---|---|---|
| 5,884,382 | A | 3/1999 | Hansen | |
| 5,950,884 | A * | 9/1999 | Payne | 223/85 |
| 5,957,344 | A * | 9/1999 | Kolton | 223/85 |
| 6,108,821 | A * | 8/2000 | Malsoute | 2/321 |
| 6,425,139 | B1 | 7/2002 | Ida | |
| 6,497,347 | B1 * | 12/2002 | Feibelman et al. | 223/87 |
| 6,920,672 | B1 | 7/2005 | Hubbard | |
| D541,056 | S * | 4/2007 | Magwood | D6/315 |
| 7,448,520 | B2 * | 11/2008 | Kolton et al. | 223/85 |
| D621,585 | S | 8/2010 | Waldman | |
| 8,029,185 | B2 | 10/2011 | Faucher et al. | |
| 2008/0073387 | A1 * | 3/2008 | Godfrin | 223/87 |
| 2009/0188953 | A1 * | 7/2009 | Schulman | 223/87 |
| 2010/0251462 | A1 | 10/2010 | Bauhuis | |
| 2012/0280524 | A1 | 11/2012 | Izzo | |

OTHER PUBLICATIONS www.slidebelts.com. Slide Belts: About Us. Published circa Apr. 2012.

* cited by examiner

HANGING DEVICE FOR BELTS

BACKGROUND

1. Field of the Invention

The present invention relates to hanging devices which may be used in merchandising accessories. More particularly, the present invention relates to hang tags and hangers that may be used in the sale of belts.

2. State of the Art

In the sale of various items, it is common to use hang tags, hangers and other hanging devices. The hang tag allows a piece of merchandise to be attached to a display rack without penetrating the article and reducing the risk that sliding the merchandise back and forth on a post will damage the item. As shown in FIG. 1, it is common for the hang tag 4 to be made of plastic. The hang tag 4 has a body 8 which includes an upper end 12 which may include a hole or slot 16 which enables the hang tag to be suspended from a post on a display rack. The lower portion 22 of the body 8 of the hang tag 4 may be doubled over and the end 26 attached (commonly by a plastic rivet) to the body 8. The loop formed by folding over the body holds the outer portion of the buckle 30 of the belt 34. The body 8 may also have a hole or holes which received and holds the prong(s) 38 of the belt 34 to prevent it from interfering with or damaging adjacent belts.

One problem with such hang tags 4 is that they often require a knife or scissors to remove the hang tag from the belt 24. This can be inconvenient if the belt is needed promptly (i.e. a businessman or woman who has forgotten their belt and is purchasing one on the way to a meeting).

Another problem is the hang tags 4 may be less convenient for use in other types of belts, such as hole-less belts. In hole-less belts, the belt lacks a prong which extends through holes in the belt. Rather, they rely on some other engagement mechanism for preventing a portion of the belt from being pulled out of the buckle. For example, in one such belt, the buckle includes a ratchet member which is biased into a closed position. The back side of the belt includes a plurality of teeth. As the teeth are slid past the ratchet mechanism, the belt can advance through the buckle to tighten the belt. The belt cannot be pulled back the other direction, however, because of the engagement of the teeth with the ratchet mechanism. Such belts are particularly advantageous because they tend to provide finer adjustment (i.e. every ¼ inch) than a regular belt (i.e. every inch). This makes the belt more comfortable for the wearer and reduces damage to the belt cause by the belt being too tight on the wearer.

Because the buckle lacks an outer buckle loop similar to a conventional buckle, the hang tag 4 shown in FIG. 1 is less feasible. While a plastic clip may be placed about the base of the buckle to attach a hang tag, this often requires the clip to be cut and risks scratching or otherwise damaging the belt or buckle.

Hole-less belts also create a problem for storage. Many individuals store their belts by placing the hook of a hanger through the void in the buckle and allow the belt to be suspended from the hanger. Numerous belts can be held on such a hanger. In the alternative, a belt is often suspended from a hook on a tie valet. However, neither the hook of the tie valet nor the hanger is convenient for holding a hole-less belt because of the fundamental difference in the buckle.

Thus, there is a need for an improved hang tag for use with belts and the like. Likewise, there is a need for an improved hanger for storing or displaying belts.

SUMMARY OF INVENTION

It is an object of the invention to provide an improved hang tag.

It is another object of the present invention to provide an improved hanger for use with hole-less belts. It will be appreciated that the objects are complementary and aspects of the invention can be achieved by providing either a hang tag or a hanger and that the two do not need to be accomplished together.

The above and other objects of the present invention are achieved in a hang tag and or hanger which is configured for attachment to and removal from a piece of merchandise without damaging the merchandise. In accordance with one aspect of the invention, the hang tag or hanger includes a body, at least a portion of which is sized for insertion into a belt buckle. The body engages the belt buckle to selectively hold the hang tag to the belt buckle to thereby allow the belt to be displayed from a display post.

In accordance with another aspect of the invention, the body includes one or more projections extending therefrom. The projections are configured to engage a ratchet mechanism on a belt buckle for a hole-less belt so that the body may be slid into and be retained by the belt buckle and thereby support the weight of the belt.

In accordance with another aspect of the invention, the body includes one or more depressions disposed therein which are configured to engage a ratchet mechanism on a belt buckle for a hole-less belt so that the body may be slid into and retained by the belt buckle and thereby support the weight of the belt. The depression may be formed into the body, may be formed upon formation of the body or may be a hole in the body which receives the ratchet.

In accordance with another aspect of the invention, the portion of the body which is insertable into the belt buckle is thicker than at least one other portion of the hang tag to thereby have a thickness similar to that of the belt.

In accordance with yet another aspect of the invention, the hang tag may include a broader upper portion configured to engage a hanging post to hold the belt for display and to provide space for information about the belt to be displayed above the belt buckle.

In accordance with yet another aspect of the invention, a hanger may include one or more bodies having structures thereon for receiving the ratchet mechanism of the buckle of a hole-less belt so as to hold the belt for display or for storage. The belt hanger may include a single body for holding one belt, or may hold a plurality of bodies each configured to receive and hold the buckle of a hole-less belt.

These and other aspects of the present invention are realized in a hang tag as shown and described in the following FIGURES and related description.

BRIEF DESCRIPTION OF THE DRAWINGS

Various embodiments of the present invention are shown and described in reference to the numbered drawings wherein.

Figure 1:
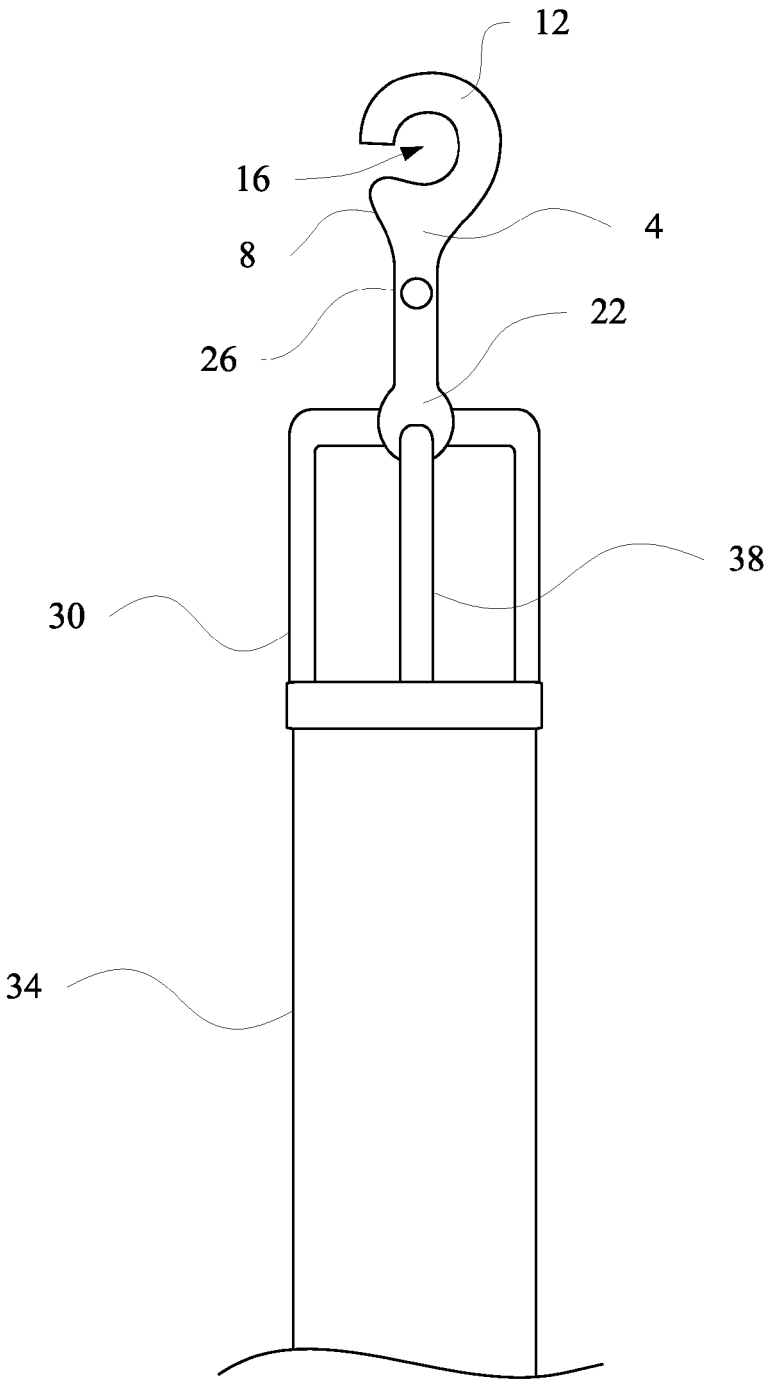
FIG. 1 (PRIOR ART)
FIG. 1 shows a front, fragmented view of a hang tag and belt as used in accordance with the teachings of the prior art.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single FIGURE, and as such, multiple FIGURES are presented to separately illustrate the various details of the invention in greater clarity. Similarly, not every embodiment need accomplish all advantages of the present invention.

DETAILED DESCRIPTION

The invention and accompanying drawings will now be discussed in reference to the numerals provided therein so as to enable one skilled in the art to practice the present invention. The skilled artisan will understand, however, that the methods described below can be practiced without employing these specific details, or that they can be used for purposes other than those described herein. Indeed, they can be modified and can be used in conjunction with products and techniques known to those of skill in the art in light of the present disclosure. The drawings and descriptions are intended to be exemplary of various aspects of the invention and are not intended to narrow the scope of the appended claims. Furthermore, it will be appreciated that the drawings may show aspects of the invention in isolation and the elements in one FIGURE may be used in conjunction with elements shown in other FIGURES.

Reference in the specification to "one embodiment," "one configuration," "an embodiment," or "a configuration" means that a particular feature, structure, or characteristic described in connection with the embodiment may be included in at least one embodiment, etc. The appearances of the phrase "in one embodiment" in various places may not necessarily limit the inclusion of a particular element of the invention to a single embodiment, rather the element may be included in other or all embodiments discussed herein.

Furthermore, the described features, structures, or characteristics of embodiments of the present disclosure may be combined in any suitable manner in one or more embodiments. In the following description, numerous specific details are provided, such as examples of products or manufacturing techniques that may be used, to provide a thorough understanding of embodiments of the invention. One skilled in the relevant art will recognize, however, that embodiments discussed in the disclosure may be practiced without one or more of the specific details, or with other methods, components, materials, and so forth. In other instances, well-known structures, materials, or operations may not be shown or described in detail to avoid obscuring aspects of the invention.

Before the present invention is disclosed and described in detail, it should be understood that the present invention is not limited to any particular structures, process steps, or materials discussed or disclosed herein, but is extended to include equivalents thereof as would be recognized by those of ordinarily skill in the relevant art. More specifically, the invention is defined by the terms set forth in the claims. It should also be understood that terminology contained herein is used for the purpose of describing particular aspects of the invention only and is not intended to limit the invention to the aspects or embodiments shown unless expressly indicated as such. Likewise, the discussion of any particular aspect of the invention is not to be understood as a requirement that such aspect is required to be present apart from an express inclusion of the aspect in the claims.

It should also be noted that, as used in this specification and the appended claims, singular forms such as "a," "an," and "the" may include the plural unless the context clearly dictates otherwise. Thus, for example, reference to "a spring" may include an embodiment having one or more of such springs, and reference to "the layer" may include reference to one or more of such layers.

As used herein, the term "substantially" refers to the complete or nearly complete extent or degree of an action, characteristic, property, state, structure, item, or result to function as indicated. For example, an object that is "substantially" enclosed would mean that the object is either completely enclosed or nearly completely enclosed. The exact allowable degree of deviation from absolute completeness may in some cases depend on the specific context, such that enclosing the nearly all of the length of a lumen would be substantially enclosed, even if the distal end of the structure enclosing the lumen had a slit or channel formed along a portion thereof. The use of "substantially" is equally applicable when used in a negative connotation to refer to the complete or near complete lack of an action, characteristic, property, state, structure, item, or result. For example, structure which is "substantially free of" a bottom would either completely lack a bottom or so nearly completely lack a bottom that the effect would be effectively the same as if it completely lacked a bottom.

As used herein, the term "about" is used to provide flexibility to a numerical range endpoint by providing that a given value may be "a little above" or "a little below" the endpoint while still accomplishing the function associated with the range.

As used herein, a plurality of items, structural elements, compositional elements, and/or materials may be presented in a common list for convenience. However, these lists should be construed as though each member of the list is individually identified as a separate and unique member.

Figure 2:
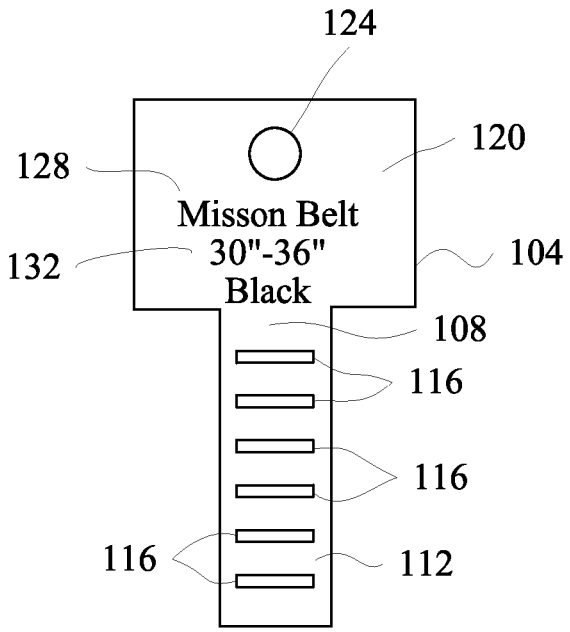
FIG. 2 shows a front view of a hang tag made in accordance with principles of the present invention.

Turning now to FIG. 2, there is shown a hang tag 104 made in accordance with principles of the present invention. The hang tag 104 includes a body 108 having a lower portion 112 sized and configured to be inserted into a belt buckle of a hole-less belt. The lower portion 112 includes one or more engagement structures, such as protrusions 116 extending outwardly from the body. As will be explained below, the protrusions 116 on the lower portion 112 are configured to engage a ratchet mechanism of a belt buckle.

The body 108 of the hang tag 104 also includes an upper portion 120. The upper portion may have a slot or hole 124 formed therein for receiving a display post of a display rack, etc. to thereby allow the hang tag 104 to hang from the post. The upper portion 120 may be wider and/or longer than the lower portion 112 to facilitate the display of information about the product to which the hang tag 104 is attached. For example, the upper portion 120 may have a brand name 128 and product description 132 displayed thereon to facilitate merchandising of the product.

Figure 2A:
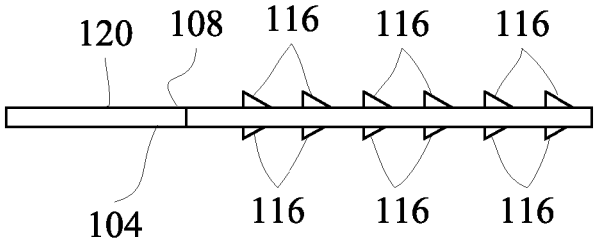
FIG. 2A shows a side view of the hang tag of FIG. 2.

Referring to FIG. 2A, there is shown a side view of the hang tag 104 of FIG. 2. The hang tag 104 may be formed so that it has one or more protrusions 116 (or other engagement members) on two sides or only on a single side. It will be appreciated, that having protrusions 116 on both sides will make insertion into the belt buckle easier, as no care need be provided to orientation. However, use of protrusions 116 on only one side of the body 108 would force one side of the upper portion 120 to be displayed, thereby allowing the hang tag 104 to have merchandising information on one "front" side and legal or other information on the back. It will be appreciated that the protrusions 116 may be made of different sizes, although they may commonly be approximately the same size as the teeth which are disposed on the back side of the belt to engage the ratchet mechanism when the belt is being worn.

While the hang tags 104 are shown with multiple protrusions or projections, it will be appreciated that a single engagement member may be used to engage the ratchet mechanism of a belt buckle on a hole-less belt.

The hang tag 104 may be made of a variety of materials including plastic, cardboard or other materials which will be strong enough to support the weight of the belt. The hang tag 104 may be injection molded or cut/punched from existing materials. In the alternative, all of part of the hang tag 104 can be made of a portion of a belt having the teeth which are engaged by the ratchet mechanism discussed below so that advancing the buckle on the hang tag 104 gives the appearance of a belt being fastened.

The hang tag 104 may be of a variety of sizes. However, it may be desirable to have the lower portion 112 of the hang tag 104 be of similar thickness to that of the belt with which it is being used. Thus, a common thickness of the lower portion, including the protrusions may be between 1/16th to 1/4th of an inch thick.

Figure 3:
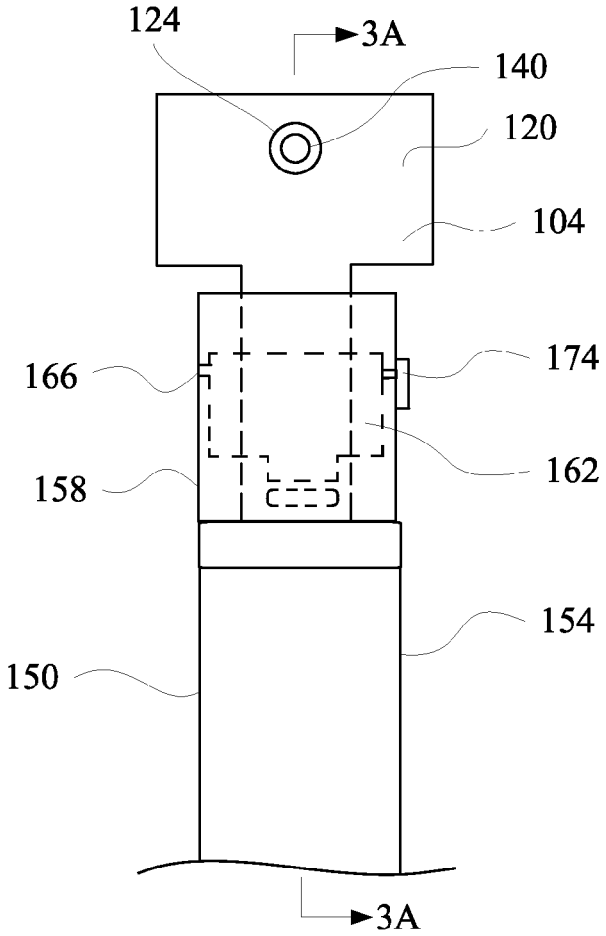
FIG. 3 shows a front, fragmented view of a belt being suspended from the hang tag of FIG. 2 in accordance with principles of the present invention.

Turning now to FIG. 3, there is show a front view of the hang tag 104 on a display post 140 with a belt 150 suspended therefrom. The belt 150 includes a belt strap 154 and a buckle 158 attached at one end. Rather than including a prong such as that shown in FIG. 1, the buckle 158 includes a ratchet mechanism 162 (shown in shadow) which is pivotably mounted within the casing 166 of the belt buckle. The ratchet mechanism 162 is biased into, but deflectable out of, a closed position such that inserting the belt strap 154, or the hang tag 104, deflects the ratchet mechanism and allows a belt or tag to advance. Once advancement ceases, the ratchet mechanism 162 is biased back into it original position and engages teeth (not shown) on the back side of the belt strap 154, or the projections 116 on the hang tag 104, to hold the belt strap or hang tag in the buckle. By pressing on a release lever 174, the ratchet mechanism can be moved out of the biased closed position to allow the belt or hang tag 104 to be pulled out of the buckle 158.

Figure 3A:
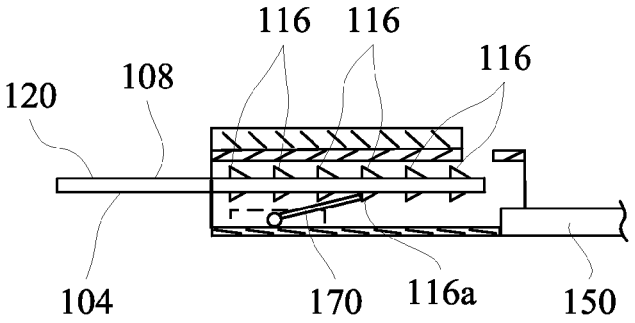
FIG. 3A shows a side, cross-sectional view of FIG. 3.

FIG. 3A shows a side, cross-sectional view of the hang tag 104 and the casing 166 of the belt buckle 158. The ratchet mechanism 162 is disposed in the normally closed position wherein it engages the protrusion 116 on the lower portion 112 of the hang tag 104. This traps the lower portion 112 of the hang tag 104 between the ratchet mechanism 162 and a lower surface of the upper portion of the casing 166 of the buckle. The protrusion 116*a* engages the ratchet mechanism and prevents the lower portion 112 of the hang tag 104 from being pulled out of the buckle, thereby allowing the hang tag to hold and display the belt 150.

Figure 4:
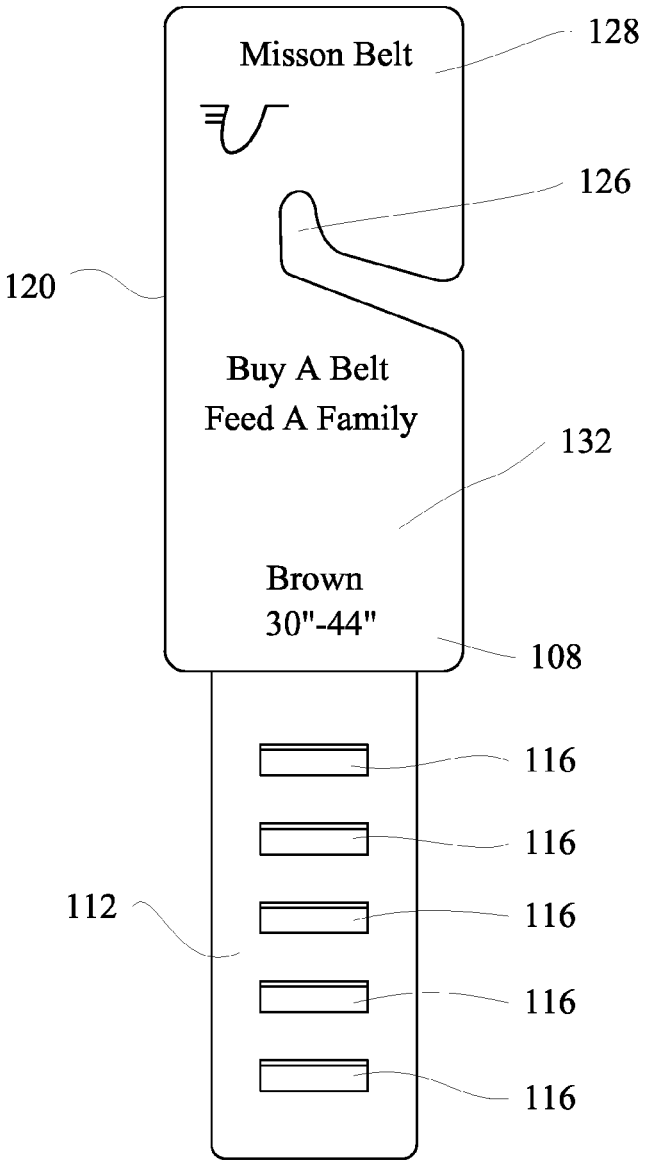
FIG. 4 shows a front view of a hang tag made in accordance with the principles of the present invention.

Turning now to FIG. 4, there is shown a front view of a hang tag 104 made in accordance with the present invention. The hang tag 104 includes body 108 a lower portion 112 configured for insertion into a belt buckle of a hole-less belt. The lower portion 112 has one or more engagement members, such as protrusions 116, for engaging a ratchet mechanism in a belt buckle.

The hang tag 104 in FIG. 4 also includes an upper portion 120 which includes a slot 126 by which the hang tag may be mounted on a display post similar to the hole 124 shown in FIGS. 2 and 3. As with the hang tag in FIGS. 2 and 3, the hang tag in FIG. 4 may have protrusions on both sides of the lower portion and may include branding 128 and other information 132 on the upper portion (and/or the lower portion) to facilitate merchandising of the product to which the hang tag is attached. For simplicity, the information 128 and 132 are shown on the same side as the projections 116 in FIG. 4. However, in some configurations, they will be disposed on opposite sides.

Figure 4A:
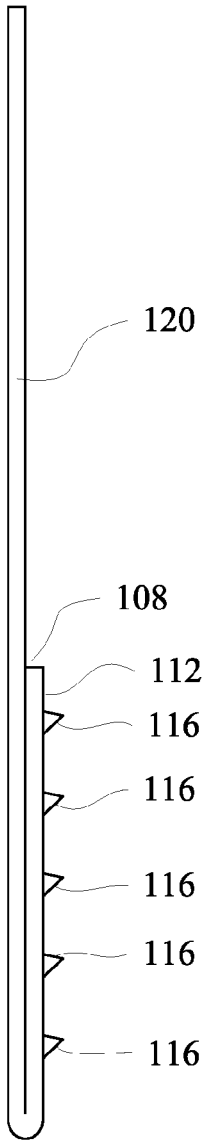
FIG. 4A shows a side view of the hang tag shown in FIG. 4.

FIG. 4A shows a side view of the hang tag 104 of FIG. 4. The lower portion 112 has been formed by taking an elongate lower portion, stamping the back side of the lower portion to form the protrusions 116, and then folding the lower portion on itself to form a thicker lower portion with the protrusions 116 on the back side. The folding of the lower portion 12 allows for the lower portion to be a thickness that more resembles that of a belt (i.e. $1/16^{th}$ to $1/4^{th}$ of an inch) without requiring the upper portion 120 to be made from so much material. The thicker lower portion 112 helps the lower portion to hold better in the belt buckle.

Figure 4B:
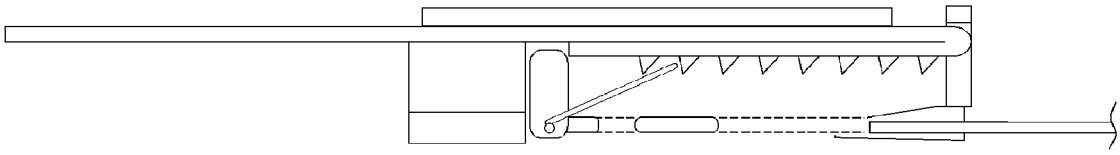
FIG. 4B shows a cross-sectional view of the hang tag of FIG. 4 disposed in a belt buckle.
Figure 4B:
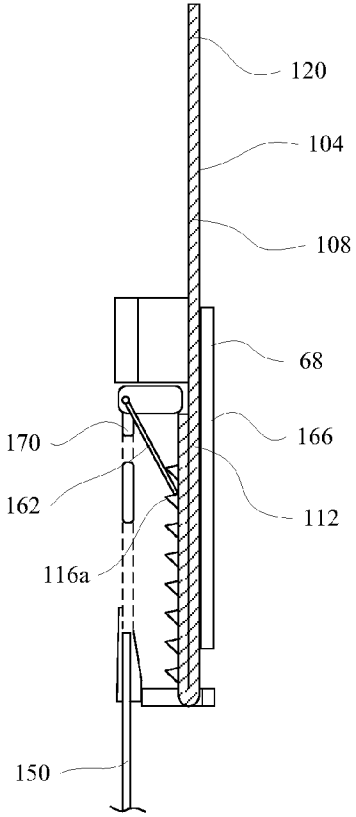

Turning now to FIG. 4B, there is shown a cross-sectional view of the hang tag 104 of FIG. 4 and the buckle end of a belt 150. The lower portion 112 is inserted into the belt buckle 158 and one of the protrusions 116*a* is engaged by the ratchet mechanism 162 and thereby holds the lower portion 112 of the hang tag 104 between the ratchet mechanism and the casing 166 of the buckle unless the release lever 170 is activated to move the ratchet lever down and disengage the ratchet mechanism from the protrusion.

While there are minor differences between the hang tags shown in FIGS. 2-3 and FIG. 4, it will be appreciated that either could be modified to have the features of the other. For example, the hang tag in FIG. 4 could have protrusions 116 on both sides and could use a hole 124 instead of a slot. Likewise, the hang tag in FIGS. 2-3 could have protrusions on only one side, could be made by folding the lower portion and/or could have a slot 126 rather than a hole 124.

The hang tags 104 of the present invention provide several advantages. First, they are relatively inexpensive and easy to use. Second, no tools are required in order to insert the hang tag 104 into the belt buckle 158. This may reduce handling. Third, the tags do not require scissors or the like to remove them from the belt 150. This prevents the purchaser from accidentally scratching the belt strap or belt buckle trying to remove the tag.

Figure 5:
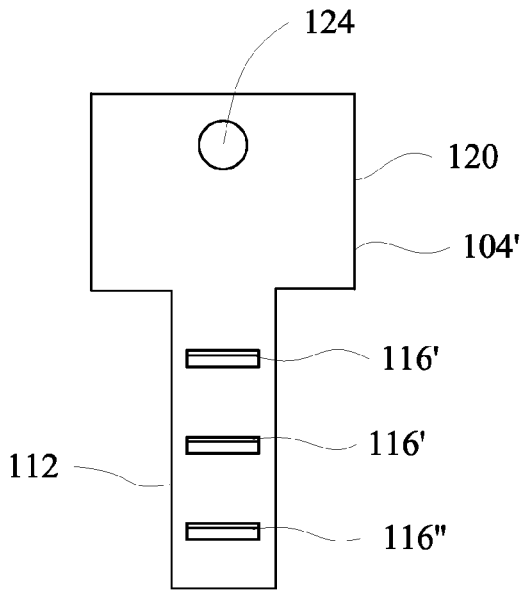
FIG. 5 shows a side view of an alternate configuration of a hang tag made in accordance with the principles of the present invention.

Turning now to FIG. 5, there is shown an alternate configuration of a hang tag 104' made in accordance with the principles of the present invention. Instead of using projections 116, the hang tag has depressions 116' which extend into the body 108 and thereby provide a surface for the ratchet mechanism on a belt buckle to engage the body and hold the belt buckle on the lower portion. As shown at 116", the depression may form a hole all the way through the hang tag 104'. The hang tag 104' works in the same manner as the hang tag 104 of FIG. 2, except that it is a surface defining the depression rather than a surface defining the projection which is engaged by the belt buckle and the ratchet mechanism of the belt buckle extends down into the depression.

Figure 6:
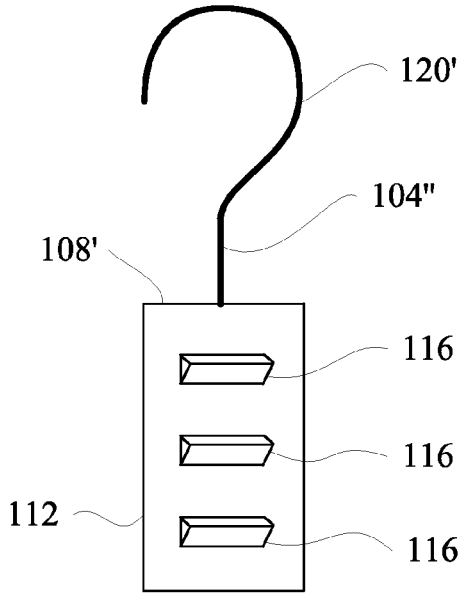
FIG. 6 shows a hanger made in accordance with principles of the present invention.

FIG. 6 shows a hanger made in accordance with the principles of the present invention. The hanger 104" includes body 108' with an upper portion 120' which forms a hook for hanging on a rail. It also includes a lower portion 112 which is formed in a similar manner to the lower portions 112 in FIG. 2 or FIG. 5 so that at least one engagement member, such as projections 116 or a depression or void, is configured to receive the ratchet mechanism of a belt buckle as discussed above. While the hang tags 104, 104' discussed with respect to FIGS. 2-5 are usable for display in a commercial environment, many people hang their belts in a closet using a hanger. Because a hanger often will not conveniently work with a hole-less belt, the hanger 104" shown in FIG. 6 is adapted to receive the belt buckle and to hold the belt buckle in place, thereby supporting the remainder of the belt.

It will be appreciated that in addition to cardboard, plastic and other materials, the lower portion 112 in FIG. 6 can be made a piece of leather, etc., with an insert with teeth similar to the engagement mechanism which occurs on a hole-less belt to give a more luxurious appearance. The lower portion can be made from actual portions of a belt (e.g. portions of a defective belt being recycled) or made specifically for use as a hanger.

Figure 7:
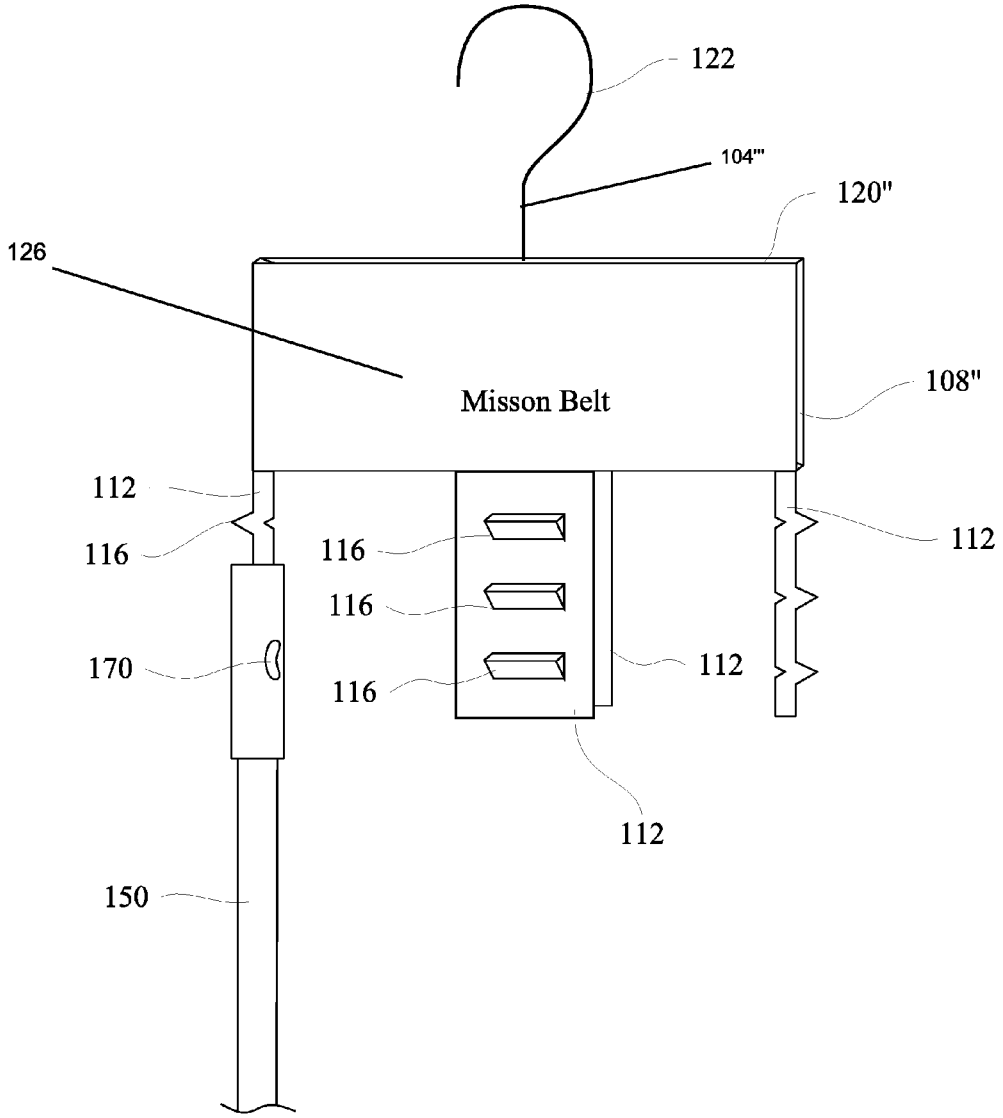
FIG. 7 shows an alternate configuration of a hanger made in accordance with principles of the present invention.

FIG. 7 shows an alternate configuration of a hanger 104' made in accordance with the principles of the present invention. The body 108" includes a plurality of lower portions 112 which include a plurality of engagement members, such as projections 116 or depressions (such as shown in FIG. 5). The upper portion 120" may be square, rectangular, circular or a host of other shapes to allow for a number of belts to be conveniently attached. The upper portion may include a hook 122 and a display portion 126 for advertising in the event that the hanger is used to display belts in a commercial setting. The hanger 104'", however, can also be used for simply holding a number of belts in one's closet.

As shown in FIG. 7, a belt 150 is attached to one of the lower portions 112 to hold the belt for storage. The belt can be removed by activating the release lever 170 of the ratchet mechanism (not show). The other lower portions 112 are empty and are capable of receiving additional belts.

Figure 8:
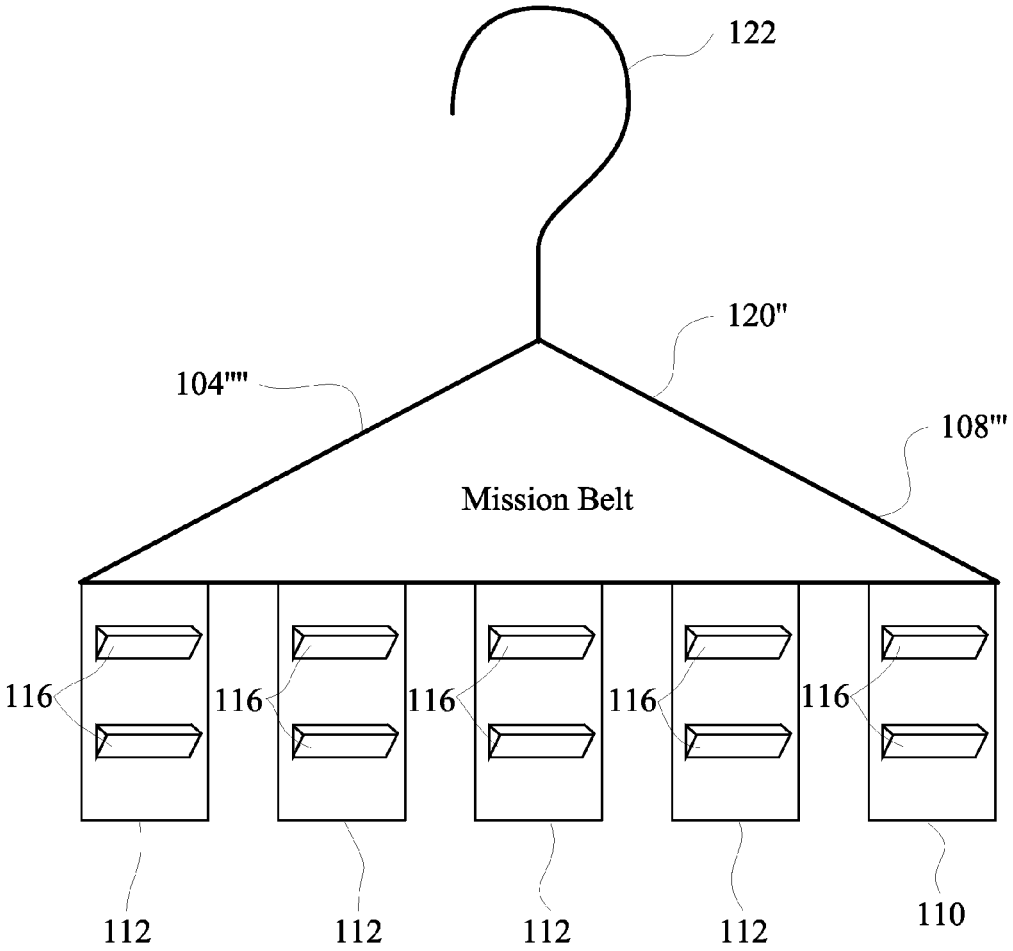
FIG. 8 shows still another embodiment of a hanger made in accordance with principles of the present invention.

FIG. 8 shows an alternate configuration of a hanger 104"". The hanger 104"" includes a body 108" which has a plurality of lower portions 112 and an upper portion 120". The lower portions 112 are similar to the lower portions shown and discussed in FIGS. 2-5, in that they may each have one or more engagement members for engaging the ratchet mechanism of the buckle of a hole-less belt. The hanger 104"" in FIG. 8 is different than that in FIG. 7 in that it is generally flat, allowing a number of belts (such as 5 or more) to be stored side by side without taking much space along a closet rail.

Figure 9:
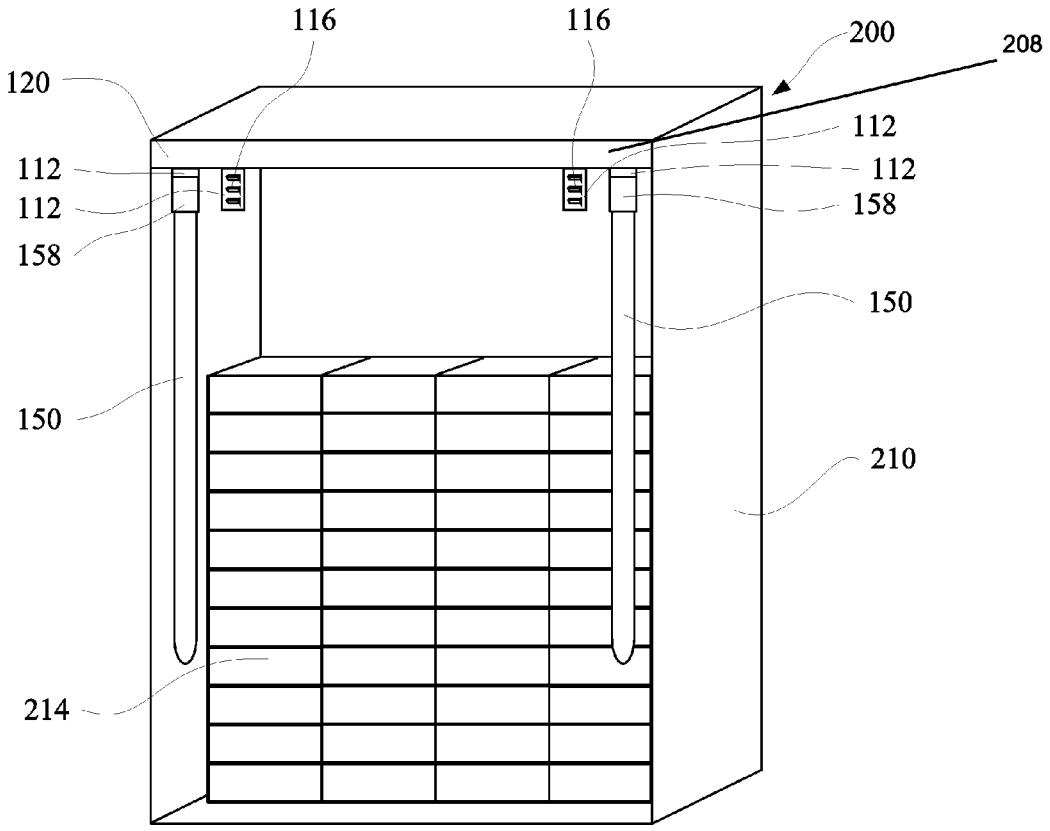
FIG. 9 shows another embodiment of a hanging device incorporated into a point of sale display.

FIG. 9 shows an alternate construction of a hanging device for displaying belts. In some point of sale configurations a hang tag, such as those discussed above, are used. In other situations, the actual product is boxed and a display is provided. Thus, the hanging device 200 shown in FIG. 9 includes a body 208 with a lower portion 112 and an upper portion 120. The upper portion 120 may be attached to for form part of a display container 210 which can hold a plurality of boxed belts 214 which are taken by customers.

The lower portions 112 may be formed in any of the manners discussed above and are designed with one or more engagement members—such as projections 116—to receive and hold a buckle 158 of a belt 150 for display to customers. Thus, for example, a number of different belt colors or styles could be displayed to customers with the belts for sale being boxed and waiting for purchase behind the displays. Such a display would meet the requirements of most "big-box" retailers and would enable customers to see how the belts work—as many people are unfamiliar with hole-less belts.

There is thus disclosed an improved hang tag, hanger and other hanging device for use with hole-less belts. Those skilled in the art will appreciate numerous modifications which may be made in light of the teachings of the present invention. The appended claims are intended to cover such modifications.

What is claimed is:

1. A hanging device having a elongate body with an upper portion and a lower portion when disposed vertically, the lower portion having a surface and a thickness generally perpendicular to the surface, the surface being wider than the thickness, and a plurality of protrusions extending from the surface, protrusions forming the plurality of protrusions being spaced apart vertically from one another when the hanging device is in an orientation for hanging a belt, the lower portion having generally planar portions disposed along the surface between the protrusions, the protrusions being positioned to engage a buckle of a belt at a plurality of locations along the lower portion, the protrusions further having a lower surface which extends outwardly from the surface of the lower portion at an upwardly sloping angle, wherein the protrusions forming the plurality of protrusions extend at substantially right angles from the surface in a generally stationary linear alignment.

2. The hanging device of claim 1, wherein the upper portion has one of a hole and a slot for mounting on a display post and the lower portion having a plurality of protrusions.

3. The hanging device of claim 1, wherein the lower portion is thicker than the upper portion, the lower portion being form by two layers of material forming the lower portion placed back to back.

4. The hanging device of claim 1, wherein the plurality of protrusions have a cross-section which is triangular in shape.

5. The hanging device of claim 1, wherein the hanging device is a hang tag made out of cardboard.

6. The hanging device of claim 1, wherein the plurality of protrusions includes at least four protrusions extending outwardly from the lower portion in linear alignment.

7. The hanging device of claim 1, wherein the projections forming the plurality of projections have a width which is greater than the thickness of the lower portion.

8. A product display comprising a hanging device having a elongate body with an upper portion and a lower portion when disposed vertically, the lower portion having a surface and a plurality of protrusions extending from the surface along one side of the lower portion, the protrusions having a lower surface which extends outwardly from the surface of the lower portion at an upwardly sloping angle; and a belt having a belt buckle with a ratchet mechanism and wherein the lower portion of the hanging device is mounted in the belt buckle with the ratchet mechanism engaging one protrusion of the plurality of protrusions to hold the belt buckle to the lower portion.

9. The product display of claim 8, wherein the belt buckle has a ratchet mechanism and wherein the ratchet mechanism engages at least one of the protrusions to selectively hold at least a portion of the hanging device in the belt buckle parallel to the length of the belt such that the belt buckle and the hanging device form a ratchet.

10. The product display of claim 8, wherein the hanging device has at least one of branding and sizing information disposed thereon.

11. A product display comprising:

a belt having a belt buckle with a ratchet mechanism which is biased into a closed position; and a hanging device, a portion of the hanging device being disposed in the belt buckle, the portion of the hanging device disposed in the belt buckle having a generally planar surface and plurality of engagement members spaced apart along the hanging device, each of the engagement members extending generally outwardly in the same direction from the hanging device independently of the other on the same side of the hanging device in a vertically linear array, one or more of the plurality of engagement members being engaged by the ratchet mechanism to selectively hold the belt buckle to the hanging device at one of a plurality of desired locations along the hanging device.

12. The product display of claim 11, wherein the belt buckle comprises a release lever for releasing the ratchet mechanism from engagement with the hanging device.

13. The product display of claim 11, wherein the hanging device includes an upper portion and a lower portion and therein the plurality of engagement members are disposed along the lower portion includes a plurality of protrusions for engaging the ratchet mechanism to hold the lower portion in the belt buckle.

14. The product display of claim 13, wherein the plurality of engagement members comprises a plurality of protrusions extending generally horizontally and generally parallel to one another, the plurality of protrusions extending from outwardly from a surface of the lower portion such that the ratchet mechanism of the belt moves toward the surface of the lower portion as it passes each projection.

15. The hanging device of claim 11, wherein the plurality of engagement members includes at least four protrusions extending outwardly at substantially right angles from the lower portion in linear alignment.

16. The hanging device of claim 11, wherein the plurality of engagement members includes at least three engagement members selected from the group consisting of depressions or holes, the at least three engagement members being disposed in linear alignment and spaced apart by generally planar portions of the lower portion, such that the ratchet mechanism can engage the hanging device and hold the belt buckle at at least three different locations.

17. A method of displaying a belt for sale, the method including:

selecting a belt having a belt buckle with a ratchet mechanism;

inserting a portion of a hanging device having a plurality of spaced apart engagement members into the belt buckle to selectively engage the ratchet mechanism at any one of a plurality of locations along the hanging device and thereby selectively secure the portion of the hang tag in the belt buckle; and suspending the belt from the hanging device; and wherein the plurality of spaced apart engagement members includes four or more projections disposed in a linear alignment with planar portions between the projections.

18. The method according to claim 17, wherein the method comprises moving the ratchet mechanism to release the hanging device and removing the hanging device from the belt buckle.

19. The method according to claim 17, wherein the method comprises selecting a hanging device in the form of a hang tag having an upper portion and a lower portion and wherein the lower portion is thicker than the upper portion and inserting the thicker lower portion into the belt buckle to engage the ratchet mechanism.

20. The method of claim 17, wherein the plurality of spaced apart engagement members includes three or more depressions or holes disposed in alignment.

21. A device for hanging a belt, the device comprising:

a body having an upper portion configured for engaging a post or rail and a lower portion, the lower portion having a front and a back and two sides extending therebetween, the front and back being wider than the sides, at least one of the front and back having a generally flat surface and at least three engagement members fixedly extending from the generally flat surface on the same side, the at least three engagement members being configured for engaging a ratchet mechanism of buckle of a hole-less belt as the buckle is advanced along the lower portion, the at least three engagement members being disposed in spaced apart linear alignment along the lower portion of the body and having generally planar surfaces between each of the at least three engagement members.

22. The device according to claim 21, wherein the upper portion comprises a hole for mounting on a post and wherein the at least one engagement member comprises a plurality of projections extending outwardly from the lower portion.

23. The device according to claim 21, wherein the device is a hang tag having a hole or slot for mounting the hang tag on a post.

24. The device according to claim 21, wherein the lower portion is doubled over on itself so as to be thicker than the upper portion.

* * * * *